US006659731B1

(12) United States Patent
Hauge

(10) Patent No.: US 6,659,731 B1
(45) Date of Patent: Dec. 9, 2003

(54) PRESSURE EXCHANGER

(75) Inventor: Leif J. Hauge, Virginia Beach, VA (US)

(73) Assignee: Energy Recovery International, Inc., Virginia Beach, VA (US)

( * ) Notice: Subject to any disclaimer, the term of this patent is extended or adjusted under 35 U.S.C. 154(b) by 0 days.

(21) Appl. No.: 09/508,694

(22) PCT Filed: Sep. 30, 1998

(86) PCT No.: PCT/NO98/00290

§ 371 (c)(1),
(2), (4) Date: Mar. 29, 2000

(87) PCT Pub. No.: WO99/17028

PCT Pub. Date: Apr. 8, 1999

(30) Foreign Application Priority Data

Oct. 1, 1997 (NO) ..... 974542

(51) Int. Cl.[7] ..... F04F 11/00
(52) U.S. Cl. ..... 417/64
(58) Field of Search ..... 417/64

(56) References Cited

U.S. PATENT DOCUMENTS 4,360,317 A * 11/1982 Vallance et al. ..... 417/64

5,051,064 A * 9/1991 Konert ..... 417/64

* cited by examiner

*Primary Examiner*—Charles G. Freay
(74) *Attorney, Agent, or Firm*—Gray Cary Ware & Freidenrich LLP

(57) ABSTRACT

A pressure exchanger for transferring pressure energy from one third flow to a second where two end covers (13, 14), a rotor (11) and a rotor liner (12) are mounted together via a centre bolt (10) in a pressure housing (1) in order to reduce elastic deformation, essentially tensile stress, and to protect the pressure exchanger against impact or shock. One end cover (13) is arranged for inlet of fluid at high pressure and outlet of the same fluid depressurized in a corresponding end cover (14) via a central course in the rotor. The second end cover (14) has in addition an inlet for fluid at low pressure and an outlet for the same fluid under high pressure. A base (2) which is attached with lease pins at the bottom of the pressure housing (1) has external connections (3, 4) and internal passages, which are connect with the inlet (24) of fluid at low pressure together with the outlet (23) for depressurized fluid in the and cover (14). A sealing ring (28) prevents the mixing of in and outgoing fluid at high pressure which is passed through the pressure housing's wall via external pipe couplings (5, 7). The pressure housing (1) has a top cover (8) which is attached via a multi-sectional locking ring (18) inserted in an internal groove in the pressure housing by means of the locking cover (20).

5 Claims, 2 Drawing Sheets

PRESSURE EXCHANGER

BACKGROUND

The invention relates to a pressure exchanger for transferring pressure energy from a fluid of one fluid system to a fluid of a second fluid system, comprising a liner and two end covers with an inlet and an outlet passage, respectively, for each fluid, and a cylindrical rotor which is provided in the liner and which is arranged for rotation about its longitudinal axis, and which has a number of through-going channels with an opening at each end arranged symmetrically about the longitudinal axis. The rotor's channels are arranged for connection with the end covers' inlet and outlet passages in such a manner that during the rotor's rotation they alternately conduct fluid at high pressure and fluid at low pressure of the respective systems.

In NO 151341 and 168548 amongst others there is disclosed a pressure exchanger of the above-mentioned type for transferring pressure energy from one fluid flow to another. The pressure exchanger comprises a housing with an inlet and an outlet port for each fluid flow and a rotor which is arranged for rotation about its longitudinal axis in the housing. The rotor has at least one through-going channel, which extends from one end of the rotor to the other end, considered in the axial direction, and alternatively connects the inlet port and the outlet port for one fluid with the outlet port and the inlet port, respectively, for the second fluid and vice versa during the rotor's rotation.

The rotor is mounted between end covers and in a housing which is subject to full compression stress. At high pressures elastic deformations occur which have a profound effect on internal clearances and fits, a situation which can be partly compensated by means of pressure balancing of the end covers, as described in NO 180599, and by substantial overdimensioning of the rotor's housing.

In order to achieve a satisfactory degree of reliability in operation when using fluids with low viscosity, e.g., water, it has proved to be necessary to employ ceramics. This is a brittle material with considerably less tensile strength than metals, and at high pressure there is a great risk of fracture if the material should be subjected to impact or shock.

Moreover, pressure exchangers of the above-mentioned type are encumbered with practical drawbacks during maintenance, since pipe couplings have to be opened in order to gain access to internal components. In order to prevent strains in the pipe couplings leading to elastic deformations of critical components, an extra arrangement is required for assembly.

The object of the invention is to provide a pressure exchanger which is not encumbered with the above disadvantages.

The distinctive properties of this pressure exchanger according to the invention are presented in the claims.

The invention will now be described in more detail with reference to the drawings which schematically illustrate one example of a pressure exchanger according to the invention.

DESCRIPTION OF A PREFERRED EMBODIMENT

Figure 1:
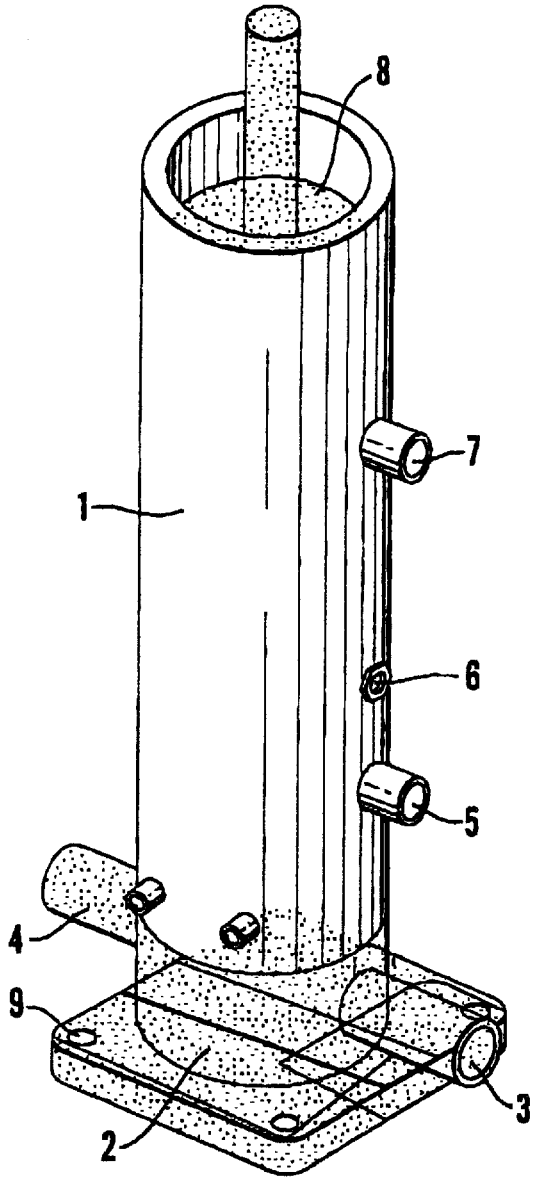
FIG. 1 is a perspective view of an embodiment of a pressure exchanger according to the invention.

As illustrated in FIG. 1 the pressure exchanger comprises a pressure housing 1 with a locking or top cover 8 and an inlet 7 for high pressure fluid and an outlet 5 for high pressure fluid, together with a window 6 for measuring the rotational speed. The maintenance of the pressure exchanger is substantially simplified due to the fact that the static components have been separated from the internal components which constitute the pressure exchanger's active unit. Furthermore, mounting has been simplified due to the fact that a base 2 with bolt holes 9 for attachment and an inlet 3 for low pressure fluid and an outlet 4 for low pressure fluid form a separate base construction which does not give rise to strain or deformations of the internal, active unit.

Figure 2:
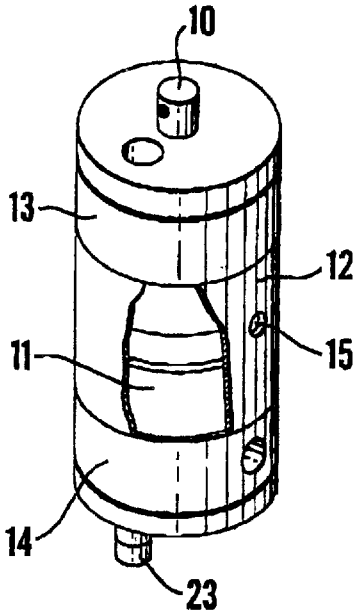
FIG. 2 is a perspective view of the internal components of the pressure exchanger illustrated in FIG. 1, some of the components being shown broken away.

FIG. 2 illustrates the different components in the internal active unit of the pressure exchanger where the pressure exchange takes place, and which are installed inside the pressure housing 1 in order to protect the components against impact or shock. Since these components are placed inside a defined space which is pressurized via the flow media on the high pressure side, any substantial overdimensioning of the components is avoided. The rotor 11 is mounted in a liner 12 where the end surfaces abut directly against the end cover 13 for pressurization of fluid and the end cover 14 for depressurization of fluid. The liner 12 has at least one opening 15 for supply of lubricating fluid and measuring the rotational speed. The liner is slightly longer than the rotor and is secured between the end covers 13, 14 via a central bolt 10 which passes through the rotor 11 without substantially reducing the flow cross section, and which is securely screwed into the opposite end cover. In addition, the design results in the sides of the end covers which face the rotor's end surfaces being subject to a static pressure which is considerably less than the pressure on the outside, since high pressure on the rotor side is essentially restricted to the inlet and outlet ports for high pressure. This is advantageous, since the play between the rotor and the end covers decreases slightly during the pressurization due to the fact that the end covers are elastically deformed towards the rotor's end surfaces. The liner 12 is also subject to compression and the corresponding force on the end covers unites or establishes the position of all the static components, preventing a mutual rotation during operation.

Figure 3:
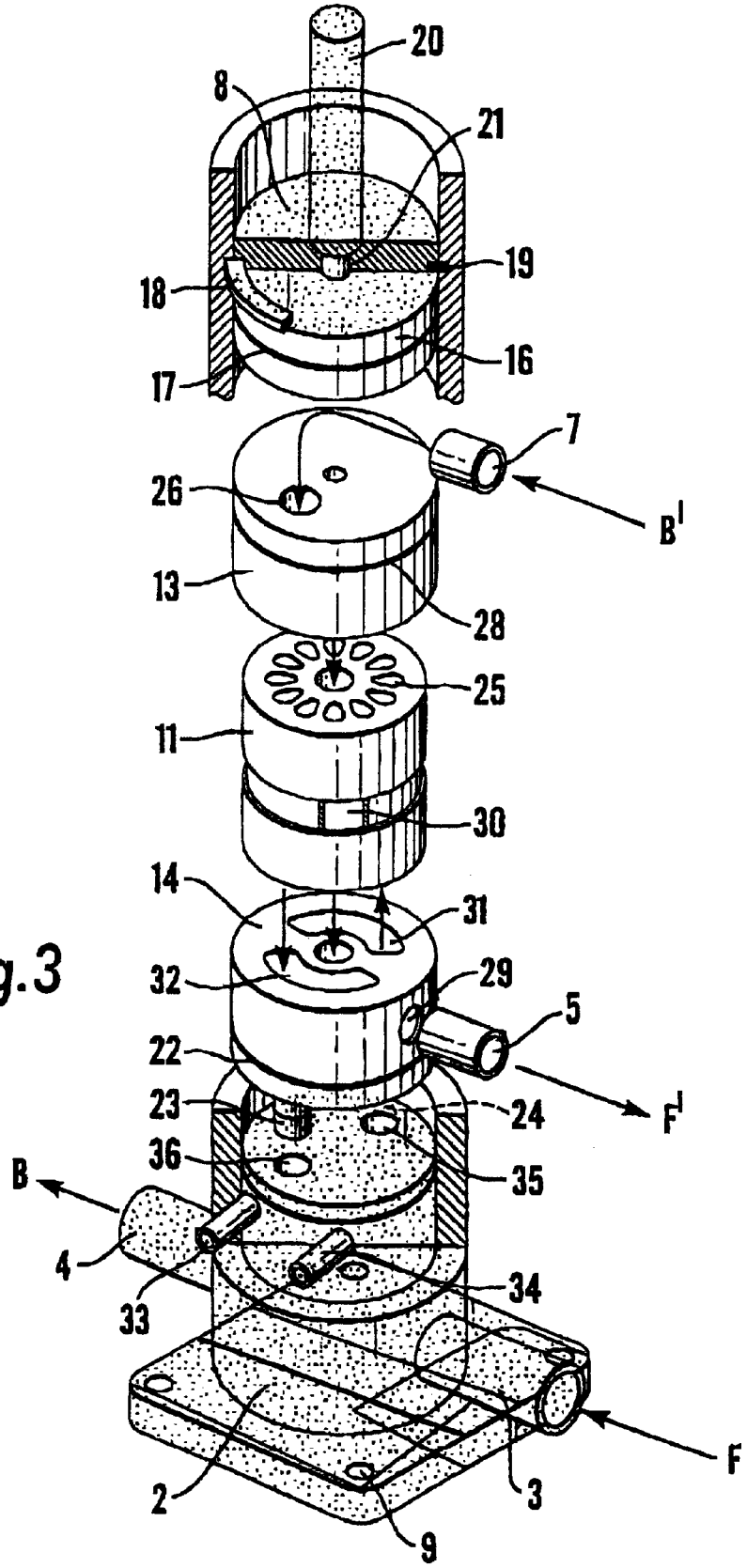
FIG. 3 is an exploded perspective view, partially broken away, of components of the pressure exchanger, where the various components have been separated from one another.

FIG. 3 illustrates the various components which are shown in FIGS. 1 and 2, these being shown separated from one another. The internal structure is accessible via a central top cover 16 which is operated without the use of special tools. A static sealing ring 17 ensures a seal against the high working pressure on the inside. The pressure housing 1 may be opened manually by rotating the locking cover 8 which is equipped with a handle 20 so that a center bolt 21 is screwed out the top cover. This releases a multi-sectional locking ring 18 which is located in a corresponding groove in the pressure housing 1 and is secured via a stepped cut-out 19 in the locking cover 8. The locking ring's individual segments are removed and the locking cover 8 is remounted, whereupon the top cover can be removed via the handle 20.

FIG. 3 further provides a detailed illustration of the design of the end covers 13, 14 and the rotor 11 which permits the advantageous separation between inlet and outlet for the high pressure side and the low pressure side, respectively. A first fluid, e.g., a liquid B', which will be depressurized in the known manner, is supplied to the rotor 11 via an inlet 7 with a direct connection to an inlet port 26 in the end cover 13. The end cover is equipped with a sealing ring 28 to prevent mixing with corresponding liquid flow on the high pressure side. At the outlet from the rotor 11 a second fluid, e.g., a liquid B, is transferred via the outlet port of the same end cover 13 to an internal passage which flows into a coaxial, central course or channel 25 in the rotor 11. From here the fluid flows out into a corresponding central, internal passage in the end cover 14 with an outlet 23 on the bottom. The end cover 14 is further provided with a sealing ring 22 which separates liquids with high and low pressure, respectively, while simultaneously causing the pressure exchanger to be exposed to a net force from the top. The low pressure port 31 has an inlet from the opening 24 in the bottom for liquid F which will be pressurized in the known manner. These inlet and outlet openings, at least one of which is designed with a pipe connection and sealing ring, are connected to corresponding openings in the pressure housing's base 2 by external pipe couplings 3, 4. The force from the liquid pressure which acts on the pressure exchanger's top, is transferred to two lease pins 33 and 34 mounted on each side of the inlet and outlet openings 35, 36 for connection with the lower end cover 14. The same end cover has a radial outlet 29 from the high pressure port 32 for the pressurized liquid F' with direct outlet via the external pipe coupling 5. The pressurized liquid F' has access to the opening 15 for hydrostatic mounting of the rotor via the clearance between the pressure housing and the end cover 14 together with the liner 12. In order to obtain an effective optical measurement of the rotational speed, the rotor 11 has a reflecting surface body 30.

What is claimed is:

1. A pressure exchanger for transferring pressure from a first fluid at high pressure to a second fluid at a lower pressure, comprising a pressure housing; and a pressure exchanger assembly disposed within the pressure housing; the pressure exchanger assembly comprising a generally cylindrically-shaped liner having first and second end covers located thereon, each end cover having one or more fluid passageways for fluid communication with an interior of the cylindrical liner; and a rotor disposed within the interior of the liner for rotation about a longitudinal access, the rotor having a plurality of channels therethrough positioned for fluid communication with said passageways within said end covers during rotation of the rotor; the pressure housing having a first inlet for communicating the first high pressure fluid to a passageway in the first end cover and having a second inlet for communicating the second lower pressure fluid to a passageway in the second end cover; and a sealing ring disposed about the second end cover for sealing engagement with the pressure housing, the sealing ring defining a high pressure area between the exterior of the liner and the pressure housing and a low pressure area adjacent to the second end cover.

2. The pressure exchanger of claim 1, wherein the liner has an opening for communicating high pressure fluid within the interior of the liner to said high pressure area.

3. A pressure exchanger according to claim 2 further comprising another sealing ring disposed about the first end cover that seals the first fluid entering the pressure housing adjacent to the first end cover from said high pressure area between the exterior of the liner and the pressure housing.

4. The pressure exchanger of claim 1, wherein said pressure housing has a tubular shape with a base which closes one end of the pressure housing adjacent the second end cover, and wherein the pressure exchanger further comprises a locking cover disposed within the pressure housing for closing an opposite end of the pressure housing adjacent the first end cover, said high pressure area including an area adjacent the first end cover and the locking cover, and said low pressure area being between the sealing ring in the second end cover and the base.

5. The pressure exchanger of claim 1, wherein the end covers are mounted on a liner by a centrally located tension bolt extending axially through the end covers and the rotor.

* * * * *